United States Patent [19]

Kessler et al.

[11] Patent Number: 4,458,650

[45] Date of Patent: Jul. 10, 1984

[54] FUEL INJECTION SYSTEM

[75] Inventors: David R. Kessler, Churchville; Noreen L. Mastro, Rochester; Jerry R. Scheller, Rochester; George L. Schultz, Rochester, all of N.Y.

[73] Assignee: General Motors Corporation, Detroit, Mich.

[21] Appl. No.: 422,036

[22] Filed: Sep. 23, 1982

[51] Int. Cl.[3] ..... F02M 39/00

[52] U.S. Cl. ..... 123/459; 123/463; 123/512; 123/514; 239/126; 137/510; 137/DIG. 8

[58] Field of Search ..... 123/459, 463, 470, 471, 123/472, 514, 512; 239/126, 124; 137/510, DIG. 8

[56] References Cited

U.S. PATENT DOCUMENTS

| | | | |
|---|---|---|---|
| 2,948,273 | 8/1960 | Suttle | 123/459 |
| 3,511,270 | 5/1970 | Fehrenbach et al. | 137/510 |
| 3,688,756 | 9/1972 | Arnaud | 123/459 |
| 3,705,572 | 12/1972 | Bloomfield | 123/459 |
| 4,079,717 | 3/1978 | Shirose | 123/516 |
| 4,231,347 | 11/1980 | Ohumi et al. | 123/512 |
| 4,235,211 | 11/1980 | Sugaya | 123/511 |
| 4,300,510 | 11/1981 | Ishida et al. | 123/463 |
| 4,341,193 | 7/1982 | Bowler | 123/472 |
| 4,347,822 | 9/1982 | Casey | 123/470 |
| 4,357,921 | 11/1982 | Ciaccio et al. | 123/463 |

FOREIGN PATENT DOCUMENTS

| | | | |
|---|---|---|---|
| 3131206 | 4/1982 | Fed. Rep. of Germany . | |
| 2031064A | 4/1980 | United Kingdom | 123/470 |

*Primary Examiner*—Charles J. Myhre
*Assistant Examiner*—Magdalen Moy
*Attorney, Agent, or Firm*—C. K. Veenstra

[57] ABSTRACT

A throttle body fuel injection system has a pressure regulator which reduces the pressure of the fuel supplied to its electromagnetic injector as the engine induction passage pressure decreases.

3 Claims, 1 Drawing Figure

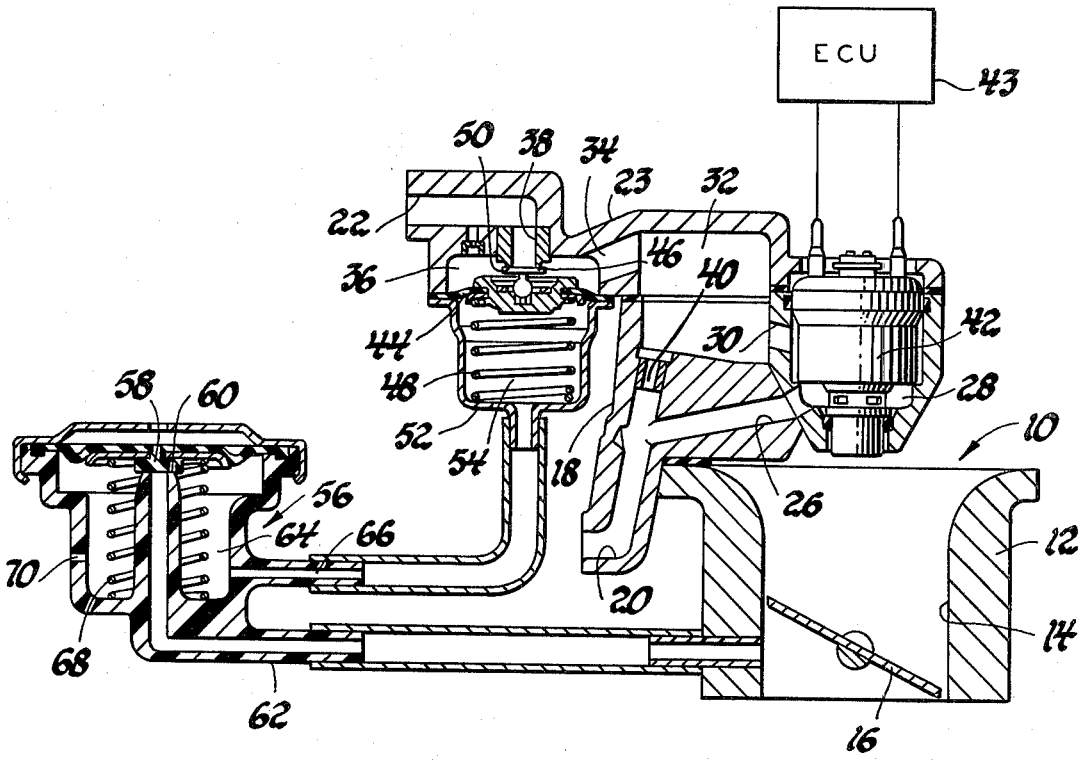
ECU
43
50
38
34
23
32
22
46
40
36
42
44
30
48
28
58
60
52
54
18
10
56
26
64
66
12
70
20
14
68
62
16

FUEL INJECTION SYSTEM

TECHNICAL FIELD

This invention relates to a fuel injection system having an electrically energized injector which delivers timed pulses of fuel to an engine induction system.

BACKGROUND

Certain automotive engines are equipped with a low pressure fuel injection system having an electrically energized injector which delivers fuel in timed pulses into the engine air induction passage above the throttle. Such a fuel injection system is currently known as a throttle body injection system or a TBI system. In a system of that nature, fuel flow is controlled by energizing the injector at regular intervals and varying the duration of the fuel delivery pulses: when increased fuel delivery is desired, the injector is energized for a longer period of time to increase the duration of the fuel delivery pulse; when decreased fuel delivery is desired, the injector is energized for a shorter period of time to decrease the duration of the fuel delivery pulse.

It has been recognized, of course, that variations in the pressure of the fuel supplied to the injector also affect fuel delivery by the injector. Accordingly, in order to provide predictable and repeatable fuel delivery by the injector in response to the duration of the fuel delivery pulses, a fuel pressure regulator is employed to maintain a constant fuel supply pressure. The fuel is supplied to the injector by a pump, and the pump supplies more fuel than is required by the injector. The excess fuel is directed through a fuel pressure regulator represented, for example, by U.S. Pat. No. 3,511,270. The pressure regulator has a diaphragm which balances the pressure of the fuel supplied to the injector with the bias of a pressure regulator spring. If the pressure of the fuel supplied to the injector is less than the spring bias, the diaphragm positions a valve to shut off the excess fuel flow and thus increase the fuel pressure at the injector; if the pressure of the fuel supplied to the injector exceeds the spring bias, the diaphragm retracts the valve to discharge the excess fuel and thus reduce the fuel pressure at the injector.

It is evident, therefore, that the fuel pressure at the injector is determined by the bias of the pressure regulator spring, and the desired fuel pressure is established by adjusting the bias of the spring.

The fuel flow orifice in an electrically energized injector must be large enough to deliver the maximum fuel flow required by the engine when the injector is continuously energized. Preferably, the fuel flow orifice is sized to deliver the maximum quantity of fuel required for any pulse when the injector is energized for a period of time which is 90% of the pulse-to-pulse interval—that is, the maximum quantity of fuel is delivered when the injector is energized with a 90% duty cycle. Then when a lesser quantity of fuel is required, the injector is energized with a proportionally lesser duty cycle. Thus it will be appreciated that the size of the fuel flow orifice establishes the duty cycle which will deliver the minimum quantity of fuel required for a pulse occurring during an operating condition such as engine deceleration. For example, an increase in the size of the fuel flow orifice necessary to increase the maximum quantity of fuel delivered by the injector is accompanied by a decrease in the duty cycle employed to deliver a specified minimum quantity of fuel in each pulse.

However, an electrically energized injector must be energized for at least a minimum period of time to deliver a predictable and repeatable quantity of fuel in each pulse. Clearly care must be exercised to avoid a situation in which the duty cycle employed to deliver the minimum quantity of fuel produces a pulse duration which is less than the minimum period of time required to deliver a predictable and repeatable quantity of fuel.

Of course, the fuel flow orifice could be sized so that the minimum quantity of fuel required for any pulse is delivered in the minimum period of time required for a predictable and repeatable fuel pulse. However, such a calibration would limit the maximum quantity of fuel which could be delivered in the maximum pulse duration. Thus the fuel flow authority of prior fuel injection systems employing electrically energized injectors has been limited by the size of the fuel flow orifice and by the minimum pulse duration.

SUMMARY OF THE INVENTION

This invention provides a fuel injection system in which the fuel flow authority is increased without affecting either the size of the fuel flow orifice or the minimum pulse duration.

In a fuel injection system according to this invention, the fuel pressure regulator is biased by a pressure signal from the engine induction passage. The pressure signal is lowest under minimum engine air flow conditions and highest under maximum engine air flow conditions and causes the pressure regulator to reduce the pressure of the fuel supplied to the injector as the engine air flow decreases. The fuel flow orifice is still sized so that the maximum quantity of fuel required for any pulse is delivered in the maximum pulse duration. With this invention, however, that calibration does not establish the duty cycle which will deliver the minimum quantity of fuel required for any pulse; the reduced fuel supply pressure requires a substantially increased duty cycle to deliver the minimum quantity of fuel required for any pulse.

Thus with this invention, the fuel flow orifice may be sized to deliver the maximum quantity of fuel required for any pulse in the time available for that pulse, and yet the duty cycle employed to deliver the minimum quantity of fuel required for any pulse will produce a pulse duration which is greater than the minimum period of time required to deliver a predictable and repeatable quantity of fuel.

The details as well as other features and advantages of the preferred embodiment of this invention are set forth in the remainder of the specification and are shown in the accompanying drawing.

SUMMARY OF THE DRAWING

The sole FIGURE of the drawing schematically illustrates a throttle body fuel injection system employing this invention.

THE PREFERRED EMBODIMENT

Referring to the drawing, the throttle body fuel injection system includes a throttle body injection or TBI assembly 10. TBI assembly 10 includes a throttle body 12 having an air induction passage 14 forming a portion of the engine air induction system and controlled by a throttle 16.

A fuel body 18 is mounted on throttle body 12. Fuel body 18 includes an inlet 20 adapted to receive fuel from a low pressure supply pump, and an excess fuel outlet 22 is formed in the fuel body cover 23.

Within fuel body 18, a passage 26 directs fuel to an injector chamber 28, and a passage 30 opens from injector chamber 28 to an intermediate chamber 32 defined between fuel body 18 and its cover 23. A pressure regulator access region 34 opens from intermediate chamber 32 to a pressure regulator chamber 36 which discharges through a passage 38 to outlet 22.

A bypass 40 opens from passage 26 to intermediate chamber 32, thereby allowing any fuel vapor present in passage 26 to bypass injector chamber 28.

From the foregoing, it may be seen that the fuel flow path extends from inlet 20 through passage 26, injector chamber 28, passage 30, intermediate chamber 32, access region 34, pressure regulator chamber 36 and passage 38 to outlet 22. Fuel circulating through this path cools fuel body 18 to maintain the TBI system below temperatures where fuel vapor might otherwise be generated.

An electromagnetic injector 42 is mounted in injector chamber 28 for energization in a conventional manner by an electronic control unit 43 to deliver fuel in timed pulses from injector chamber 28 into the region of air induction passage 14 above throttle 16. In order that injector 42 may deliver a predictable and repeatable amount of fuel to air induction passage 14 in response to variations in the duration of the timed pulses, a desired supply pressure is established in injector chamber 28. To this end, cover 23 forms a base for a pressure regulator diaphragm 44 which closes pressure regulator chamber 36 and carries a pressure regulator valve 46. A spring 48 biases pressure regulator diaphragm 44 and valve 46 upwardly toward engagement of valve 46 with a valve seat 50 formed above the portion of the fuel flow path opening from pressure regulator chamber 36 to passage 38. Should the supply pressure in pressure regulator chamber 36, and thus in injector chamber 28, rise above the desired supply pressure, diaphragm 44 is displaced downwardly against the bias of spring 48 to pull valve 46 away from valve seat 50; additional fuel is thereby permitted to flow from pressure regulator chamber 36 to passage 38 to reduce the supply pressure in pressure regulator chamber 36 and injector chamber 28. Should the supply pressure in pressure regulator chamber 36 and injector chamber 28 fall below the desired supply pressure, spring 48 displaces diaphragm 44 upwardly to push valve 46 toward valve seat 50; fuel flow from pressure regulator chamber 36 to passage 38 is accordingly reduced to increase the supply pressure in pressure regulator chamber 36 and injector chamber 28. Under steady state conditions with the desired pressure in pressure regulator chamber 36, diaphragm 44 will position valve 46 somewhat away from seat 50, allowing a continuous flow of fuel through fuel body 18.

A spring housing 52 surrounds spring 48 to define a bias pressure chamber 54 below diaphragm 44. Chamber 54 is connected through a valve assembly 56 to induction passage 14 downstream of throttle 16.

Within valve assembly 56 a diaphragm valve member 58 is associated with a valve seat 60 to control communication between a fitting 62 connected to induction passage 14 and a chamber 64 connected through a fitting 66 to bias pressure chamber 54. A spring 68 urges diaphragm valve member 58 away from valve seat 60 to communicate the subatmospheric induction passage pressure (also known as manifold pressure) from induction passage 14 through chamber 64 to bias pressure chamber 54.

When the pressure in chamber 64—and thus in bias pressure chamber 54—drops below the predetermined setting of spring 68, diaphragm valve member 58 engages seat 60 to thereby establish a lower limit for the pressure applied to bias pressure chamber 54. A restricted air bleed 70 opens into chamber 64 to gradually increase the pressure chamber 64. Thus when the induction passage pressure is below the setting of spring 68 (that is, when the manifold vacuum is above the setting of spring 68), diaphragm valve member 58 will cycle on and off seat 60 to maintain the pressure in chamber 64 and in bias pressure chamber 54 at the predetermined lower limit established by spring 68.

When the induction passage pressure rises above the setting of spring 68 (that is, when the manifold vacuum drops below the setting of spring 68), spring 68 displaces diaphragm valve member 58 from seat 60 and bias pressure chamber 54 is subjected to the induction passage pressure.

The pressure in induction passage 14 below throttle 16 varies with engine air flow and is lowest at the lowest engine air flow and highest at the highest engine air flow. Application of induction passage pressure to bias pressure chamber 54 accordingly reduces the upward bias on pressure regulator diaphragm 44 as engine air flow decreases. In response, diaphragm 44 positions valve 46 to reduce the fuel supply pressure as engine air flow decreases. The reduced fuel supply pressure decreases the quantity of fuel which injector 42 can deliver in any particular pulse duration.

Electronic control unit 43 responds to signals such as engine speed and induction passage pressure which together represent air flow through induction passage 14, and energizes injector 42 to deliver fuel in pulses which are timed to provide the desired mixture of air and fuel. It will be appreciated that, when employing this invention, electronic control unit 43 must prolong the injector energization period to compensate for the change in the fuel supply pressure; when electronic control unit 43 has a memory addressed by engine speed and induction passage pressure to establish the period of time for which injector 42 is to be energized, the time periods corresponding to induction passage pressures above the lower limit established by valve assembly 56 are extended to compensate for the change in the fuel supply pressure. Then as the fuel supply pressure is reduced with engine air flow, electronic control unit 43 increases the duty cycle over what would otherwise be called for to thereby deliver the quantity of fuel required for any pulse. Thus this invention allows an increase in the duty cycle employed to deliver the minimum quantity of fuel in any pulse and thereby assures that the minimum quantity of fuel required for any pulse is delivered in a period of time which can produce a predictable and repeatable amount of fuel.

Valve assembly 56 establishes a lower limit for the pressure applied to bias pressure chamber 54 and thereby assures that the fuel supply will be maintained at or above the pressure required for proper fuel delivery by injector 42.

This invention has been described with reference to a system in which the injector is energized at regular intervals for a period of time which may be varied—that is, a pulse width modulated system. It will be appreciated, of course, that the frequency of injection is preferably varied to coincide with the frequency of the combustion events in the engine and thus increases with engine speed. It also will be appreciated that this invention could be employed in a system in which the injector is energized for a fixed period of time at intervals which are reduced as the fuel flow requirement increases—that is, a frequency modulated system.

Moreover, it will be appreciated that this invention also could be employed in a fuel injection system having an atmospherically vented injector which delivers fuel through a region of atmospheric pressure into the engine induction system at the combustion chamber inlet port instead of through a region of atmospheric pressure above the throttle as shown in the drawing.

As described above, this invention is employed to vary the pressure of the fuel supplied to an injector which delivers timed pulses of fuel into a region of atmospheric pressure; accordingly, this invention achieves its objective by reducing the difference between the fuel supply pressure and the injector discharge pressure as engine air flow decreases. It should be appreciated, therefore, that this invention also may be employed in a fuel injection system having an injector which delivers fuel directly into the engine induction system at the combustion chamber inlet port. Such a system conventionally has a pressure regulator bias chamber connected to the air induction system downstream of the throttle to maintain a constant difference between the fuel supply pressure and the injector discharge pressure; with this invention, on the other hand, the fuel supply pressure in such a system would be reduced at a greater rate than the induction passage pressure to reduce the difference between the fuel supply pressure and the injector discharge pressure as engine air flow decreases.

The embodiments of the invention in which an exclusive property or privilege is claimed are defined as follows:

1. The method of operating a fuel injection system for an engine having an induction passage for air flow to the engine and a throttle in said passage for controlling air flow therethrough, said fuel injection system comprising an electrically energized fuel injector adapted to deliver timed pulses of fuel into a region of said induction passage, a control unit energizing said injector and adapted to establish the duration of said pulses and the interval between said pulses, a fuel passage for supplying fuel to said injector, and a pressure regulator for controlling fuel flow through said fuel passage, said pressure regulator including a diaphragm overlying a base and defining a fuel chamber therebetween, said base having a fuel access region opening from said fuel passage to said chamber and a fuel outlet opening from said chamber and a valve seat surrounding said outlet, said diaphragm carrying a valve member controlling fuel flow past said valve seat through said outlet, a spring engaging said diaphragm and biasing said diaphragm to urge said valve member toward said valve seat, and a housing overlying said diaphragm and defining a bias pressure chamber therebetween, said method comprising the steps of subjecting said bias pressure chamber to the pressure in said induction passage downstream of said throttle to thereby further bias said diaphragm to urge said valve member toward said valve seat, whereby fuel flow past said valve seat through said outlet is controlled to balance the fuel pressure on said diaphragm with the combination of the bias of said spring on said diaphragm and the bias of said induction passage pressure on said diaphragm, and causing the bias of said induction passage pressure on said diaphragm to decrease the difference between the pressure of the fuel supplied to said injector and the pressure in said region as said induction passage pressure decreases to decrease the fuel delivery capacity of said injector as air flow decreases.

2. A fuel injection system for an engine having an induction passage for air flow to the engine and a throttle in said passage for controlling air flow therethrough, said fuel injection system comprising an electrically energized fuel injector adapted to deliver timed pulses of fuel into a region of substantially constant pressure in said induction passage, a control unit energizing said injector and adapted to establish the duration of said pulses and the interval between said pulses, a fuel passage for supplying fuel to said injector, and a pressure regulator for controlling fuel flow through said fuel passage, said pressure regulator including a diaphragm overlying a base and defining a fuel chamber therebetween, said base having a fuel access region opening from said fuel passage to said chamber and a fuel outlet opening from said chamber and a valve seat surrounding said outlet, said diaphragm carrying a valve member controlling fuel flow past said valve seat through said outlet, a spring engaging said diaphragm and biasing said diaphragm to urge said valve member toward said valve seat, and a housing overlying said diaphragm and defining a bias pressure chamber therebetween, and wherein said fuel injection system further comprises means for subjecting said bias pressure chamber to the pressure in said induction passage downstream of said throttle to thereby further bias said diaphragm to urge said valve member toward said valve seat, whereby fuel flow past said valve seat through said outlet is controlled to balance the fuel pressure on said diaphragm with the combination of the bias of said spring on said diaphragm and the bias of said induction passage pressure on said diaphragm, said fuel injection system thereby reducing the pressure of the fuel supplied to said injector as said induction passage pressure decreases to decrease the fuel delivery capacity of said injector as air flow decreases.

3. A fuel injection system for an engine having an induction passage for air flow to the engine and a throttle in said passage for controlling air flow therethrough, said fuel injection system comprising an electrically energized fuel injector adapted to deliver timed pulses of fuel into a region of substantially constant pressure in said induction passage, a control unit energizing said injector and adapted to establish the duration of said pulses and the interval between said pulses, a fuel passage for supplying fuel to said injector, and a pressure regulator for controlling fuel flow through said fuel passage, said pressure regulator including a diaphragm overlying a base and defining a fuel chamber therebetween, said base having a fuel access region opening from said fuel passage to said chamber and a fuel outlet opening from said chamber and a valve seat surrounding said outlet, said diaphragm carrying a valve member controlling fuel flow past said valve seat through said outlet, a spring engaging said diaphragm and biasing said diaphragm to urge said valve member toward said valve seat, and a housing overlying said diaphragm and defining a bias pressure chamber therebetween, and wherein said fuel injection system further comprises means for applying a pressure signal created in said induction passage downstream of said throttle to said bias pressure chamber to thereby further bias said diaphragm to urge said valve member toward said valve seat, and including means establishing a lower limit for the pressure signal applied to said bias pressure chamber, whereby fuel flow past said valve seat through said outlet is controlled to balance the fuel pressure on said diaphragm with the combination of the bias of said spring on said diaphragm and the bias of said pressure signal on said diaphragm, said fuel injection system thereby reducing the pressure of the fuel supplied to said injector as said induction passage pressure decreases above said lower limit to decrease the fuel delivery capacity of said injector as air flow decreases.

* * * * *